US005936173A

United States Patent [19]

Tonon

[11] Patent Number: 5,936,173

[45] **Date of Patent: *Aug. 10, 1999**

[54] SUSPENSION OF MUSICAL INSTRUMENTS

[76] Inventor: Thomas S. Tonon, 35 Birch Ave., Princeton, N.J. 08542

[ * ] Notice: This patent is subject to a terminal disclaimer.

[21] Appl. No.: 08/781,372

[22] Filed: Jan. 21, 1997

Related U.S. Application Data

[63] Continuation-in-part of application No. 08/454,017, May 30, 1995, which is a continuation-in-part of application No. 07/754,568, Sep. 4, 1991, abandoned.

[51] Int. Cl.[6] ..... G10D 3/00

[52] U.S. Cl. ..... 84/327

[58] Field of Search ..... 84/327; 224/910, 224/258, 257, 202, 204, 272

[56] References Cited

U.S. PATENT DOCUMENTS

| | | | |
|---|---|---|---|
| 5,291,816 | 3/1994 | Adams | 84/327 |
| 5,483,860 | 1/1996 | Adams | 84/327 |
| 5,596,158 | 1/1997 | Tonon | 84/327 |

*Primary Examiner*—William M. Shoop, Jr.
*Assistant Examiner*—Kim Lockett
*Attorney, Agent, or Firm*—George E. Kersey, Esq.

[57] ABSTRACT

A three-point harness for suspending a musical instrument, such as a guitar, about the body of a musician, with a first connector for attaching the harness to one attachment point on the instrument, a second connector for attaching the harness to another attachment point on the instrument, and a third connector between the first and second connectors, attached to the instrument for limiting the extent to which the instrument can be displaced from the harness.

20 Claims, 6 Drawing Sheets

SUSPENSION OF MUSICAL INSTRUMENTS

BACKGROUND OF THE INVENTION

This is a continuation-in-part of Ser. No. 08/454,017, Filed May 30, 1995, which is, in turn, a continuation-in-part of Ser. No. 07/754,568, Filed Sep. 4, 1991, now abandoned. The invention relates to the suspension of musical instruments, and more particularly, to the suspension of stringed instruments, such as guitars, which have an unbalanced center of mass.

Large stringed instruments, such as guitars, which are commonly suspended about the shoulder of the musician, are held by a harness, which often has both of its ends attached to the main body of the instrument.

In many modern stringed instruments, such as guitars, there is an elongated neck that extends from the body of the instrument and terminates in a head pad with laterally protruding keys or knobs by which the strings can be adjusted. Because the head pad tends to be enlarged for aesthetic and utilitarian reasons, it applies a substantial amount of torque to the main body of the instrument through the elongated neck, when both ends of the harness are attached to the main body, resulting in an imbalance. Thus, the guitar player generally has to apply pressure with his arm to the base of the guitar near where the harness is attached, in order to balance the instrument.

In another common method of suspending large instruments, such as guitars, by a shoulder harness, one end of the harness is attached to the main body of the instrument, and the other end of the harness is attached to part of the instrument removed from the main body. For example, guitars are sometimes suspended by means of a strap with one end attached to the main body of the guitar and with the other end attached to the head pad, which is attached to the main body by an elongated neck. With such suspension, the instrument tends to rest with its center of gravity directly below the region where the harness contacts the shoulder of the musician. With instruments having very long necks, such suspension causes the active playing area of the instrument to lie out of convenient reach of the musician. The musician must then apply a force to the instrument in order to swing the active playing area of the instrument to a convenient position. A further disadvantage of such suspension for relatively large instruments is the length the harness must traverse, and the necessarily small angle the harness makes with the neck of the instrument. There results a loose and insecure positioning of the instrument with respect to the musician. The harness tends to slip from the shoulder of the musician, and the musician must continually adjust the position of the instrument.

Accordingly, it is an object of the invention to facilitate the suspension of musical instruments. A related object is to facilitate the suspension of stringed instruments, such as guitars with long necks.

A further object of the invention is to facilitate the suspension of musical instruments which tend to be unbalanced or insecure in their conventional suspension.

SUMMARY OF THE INVENTION

In accomplishing the foregoing and related objects, the invention provides for the suspension of musical instruments by means of a harness, with connection to two attachment points on the instrument, and with an additional intermediate connection to the instrument that limits the extent to which the instrument can be displaced from the harness.

In accordance with one aspect of the invention, the harness consists of a strap, each end of which attaches to two attachment points on the instrument, and an intermediate attachment, which attaches to a third, separate and distinct attachment point on the instrument, and which affixes to the strap, or loops about the strap, at a position intermediate the two strap ends. The intermediate attachment is adjustable, for example, in length. Its position of contact with the strap is also adjustable.

In accordance with another aspect of the invention, the instrument is a guitar having a main body and a neck extending from the main body to a terminal head end, and a strap is attached at one end to the head of the instrument and at the other end to a portion of the main body remote from the head end. The intermediate attachment is to the main body in the vicinity of the connection of the main body to the neck. The strap desirably has a thickness which is less than its width and is removably attached to the instrument.

In accordance with still another aspect of the invention, the instrument is a guitar having a main body and a neck extending from the main body to a terminal head end, and a strap is attached at a first end to a portion of the main body remote from the head end and at a second end is attached to the main body in the vicinity of the connection of the main body to the neck. The intermediate attachment is to the main body, in the vicinity of the connection of the main body to the neck and removed from the position of attachment of the second end of the strap.

In a method according to the invention of balancing an instrument with respect to the body of a player, the steps include (a) attaching to the instrument a three-point harness formed by a strap and an intermediate attachment; and (b) positioning a portion of the strap on the body of the player. The strap is positioned to achieve a balanced orientation of the instrument without requiring the need for applying a countervailing torque to the instrument. When the instrument is a guitar, a member of the harness, such as a strap, extends about the neck of the player and rests on the shoulder, in the vicinity of the collar bone. The method can include the further step of adjusting the strap in relation to its intermediate connection to the instrument. The adjustment can be made using the intermediate attachment to the strap, forming an intermediate connection that is either fixed to the strap at selectable positions, or is looped about the strap at the intermediate position. Both the length of the intermediate attachment and the location of its contact with the strap can be adjusted as needed to achieve balance and security of the instrument relative to the player.

In a combination according to the invention of a musical instrument and a suspension for the instrument, the instrument has two portions, each with its own center of mass, separated by an intervening connection, and the suspension has an attachment to each portion and a further intermediate attachment. The intervening connection can be an elongated neck, with the further attachment located near the junction of one portion and the elongated neck. One portion can be a main body and the other portion be a head member affixed at one end to the elongated neck.

When the musical instrument is a guitar with a main body joined to a head by a stringed neck, the suspension is by a strap with a first end attached to the main body, with the opposite end either attached also to the main body at a position removed from the position of attachment of the first end, or attached to the head, and with an intermediate portion of the strap attached to the main body at a position removed from the attachings of strap ends. The first end of the strap attached to the main body can be at the extremity thereof most remote from the head end. When the opposite end of the strap is attached to the main body, the attachment can be near the junction of the stringed neck and the main body. When the opposite end of the strap is attached to the head, the attachment can be near the junction of the stringed neck and the head. The intermediate portion of the strap can be attached near the junction of the stringed neck and the main body, but at a position removed from any point of attachment of the strap ends. The intermediate portion of the strap can be attached by means of an intermediate attachment, which consists of a fixed connection, or a loop encircling the strap at the intermediate position.

The length of the intermediate attachment and its position of contact to the strap can be adjustable. In the case where the intermediate connection forms a loop, the circumference of the loop can be made adjustable.

It is often preferred for the strap itself to be relatively flat in the vicinity of the musician's body parts that support the weight of the instrument. For instance, when the strap is hung over the shoulder of the musician, the part of the strap that rests on the shoulder preferably has width larger than thickness. However, other areas of the strap can have other geometries. Thus, the cross sectional shape of the strap need not be constant along the entire length of the strap. For instance, the invention discloses the strap to have circular cross section in the area where the intermediate connection attaches to the strap.

The strap itself can be comprised of more than one separate and distinct segments. Thus, the strap can consist of two smaller straps, each having a first and a second end, with both first ends attached to the instrument at two separate attachment points on the instrument. The two second ends can then be attached together, or attached to a common element, such as a ring. In the former case, the intermediate attachment can attach to the second ends, and in the latter case, the intermediate connection can attach to the common element, and in either case, the intermediate connection will attach to a third separate and distinct attachment point on the instrument. The attachment of such segments to each other or to common elements, and the attachment of the intermediate connection to the strap assembly, can take the form of a vast number of standard methods, including sewing, riveting, looping, hooking, and clipping. Such forms can result in attachings that may or may not allow freedom of movement in angular and/or linear dimensions.

The instrument of the invention can be a guitar and include the step of extending the harness about the neck of the player between two points of connection of the strap to the guitar. A further step includes adjusting a an intermediate connection that attaches to the strap at an intermediate position. The geometry of the intermediate connection can be made adjustable and so adjusted in order to achieve balance for the instrument relative to the player.

A musical instrument having several portions, each with a separate center of mass, can be combined with a harness that attaches to two portions, with a further attachment to the instrument that limits the displacement of the instrument from the harness. Additional further attachments can be made between the harness and additional, separate, and distinct attachment points on the instrument for utilitarian reasons that are suggested by logical extension.

DESCRIPTION OF THE DRAWINGS

Other aspects of the invention will become apparent after considering several illustrative embodiments, taken in conjunction with the drawings, in which.

DETAILED DESCRIPTION

Figure 1:
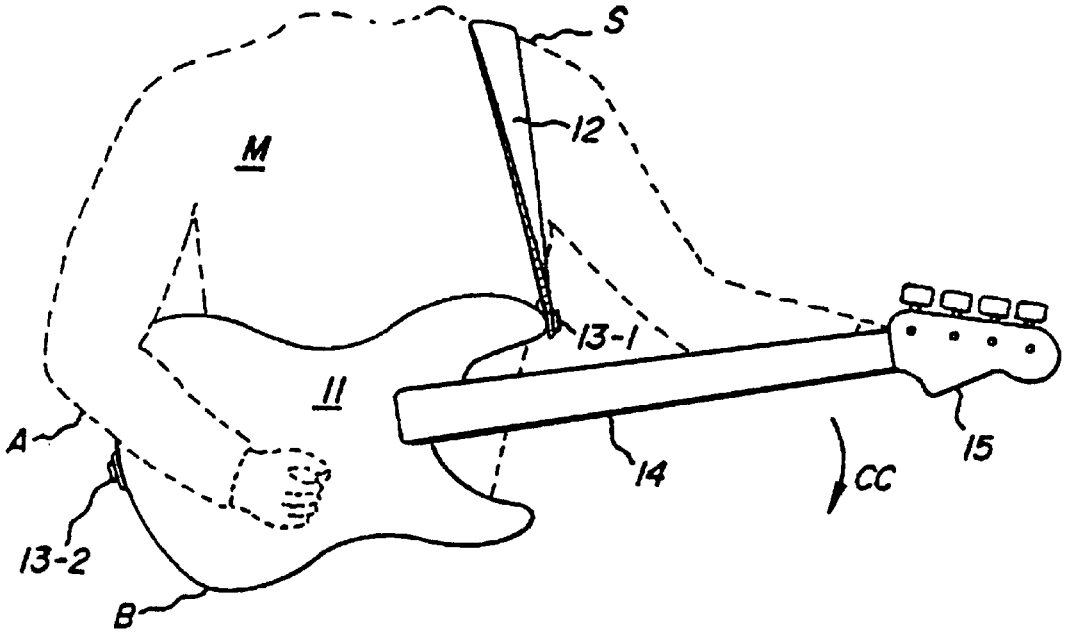
Fig. 1 PRIOR ART
FIG. 1 is a partial frontal view showing a musician with a guitar suspended from the shoulder by a conventional suspension strap of the Prior Art having both its ends attached to the main body of the guitar.

With reference to the drawings, FIG. 1 shows a musician M in phantom with guitar 11 that is suspended by a strap 12 that is attached to the at hook positions 13-1 and 13-2, extending around the shoulder S of musician M, in a conventional method of suspension. The four tuning pegs 17 are typical of bass guitars. For clarity, guitar strings are not illustrated. Because guitar 11 has an elongated neck 14 that terminates in an enlarged pad 15, the latter applies a torque to the body B of the instrument 11. The resulting torque tends to bring about a clockwise rotation of the instrument 11 in the direction indicated by clockwise arrow CC. To overcome the torque effect, it is common practice among musicians with such instruments to apply a counterclockwise countertorque with the arm A on body B. Not only does this add to the fatigue of the player, it can reduce the facility with which the musician is able to manipulate the instrument.

Figure 2:
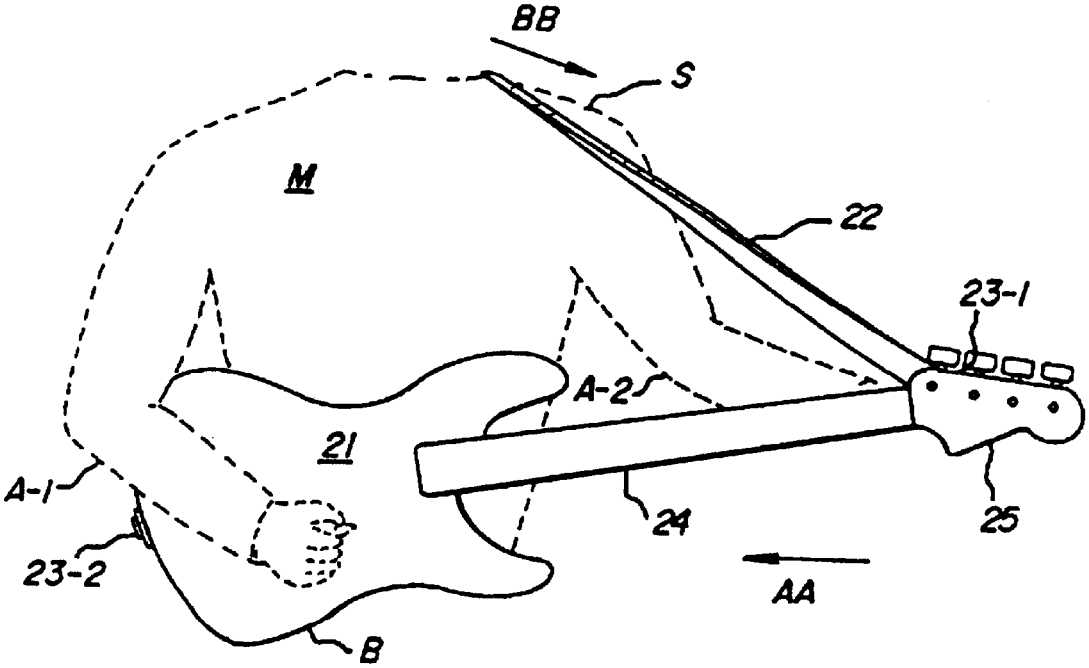
Fig. 2 PRIOR ART
FIG. 2 is a partial frontal view showing a musician with a guitar suspended from the shoulder by a conventional suspension strap of the Prior Art, with one end attached to the main body of the guitar and the other end attached to the head pad of the guitar.

FIG. 2 shows a guitar 21 that is suspended by a strap 22, which extends around the shoulder S of musician M, shown in phantom, in another conventional manner of suspension. Guitar 21 is formed by body B, elongated neck 24 and enlarged pad 25. Strap 22 is attached to the guitar at a conventional hook position 23-1 located on, and behind, the enlarged pad 25, and the hook position 23-2 on the body B. Because of the elongated neck 24, the guitar tends to swing in the direction indicated by the arrow AA. To overcome this swinging tendency, it is common practice among musicians with such instruments to apply a counter force with the arm A-1. Because of the long, unsecured span of the strap 22 between the shoulder S of the musician M and its point of attachment 23-1, and the resulting angle strap 22 makes with shoulder S, the weight of the guitar 21 tends to pull the strap 22 off the shoulder S of musician M in the direction indicated by arrow BB. When manipulation of such instruments requires rapid movement of the arm A-2, the performing musician must often readjust the position of strap 22 on shoulder S. Such compensating activity of the player causes fatigue and can reduce the facility with which the musician is able to manipulate the instrument.

Figure 3:
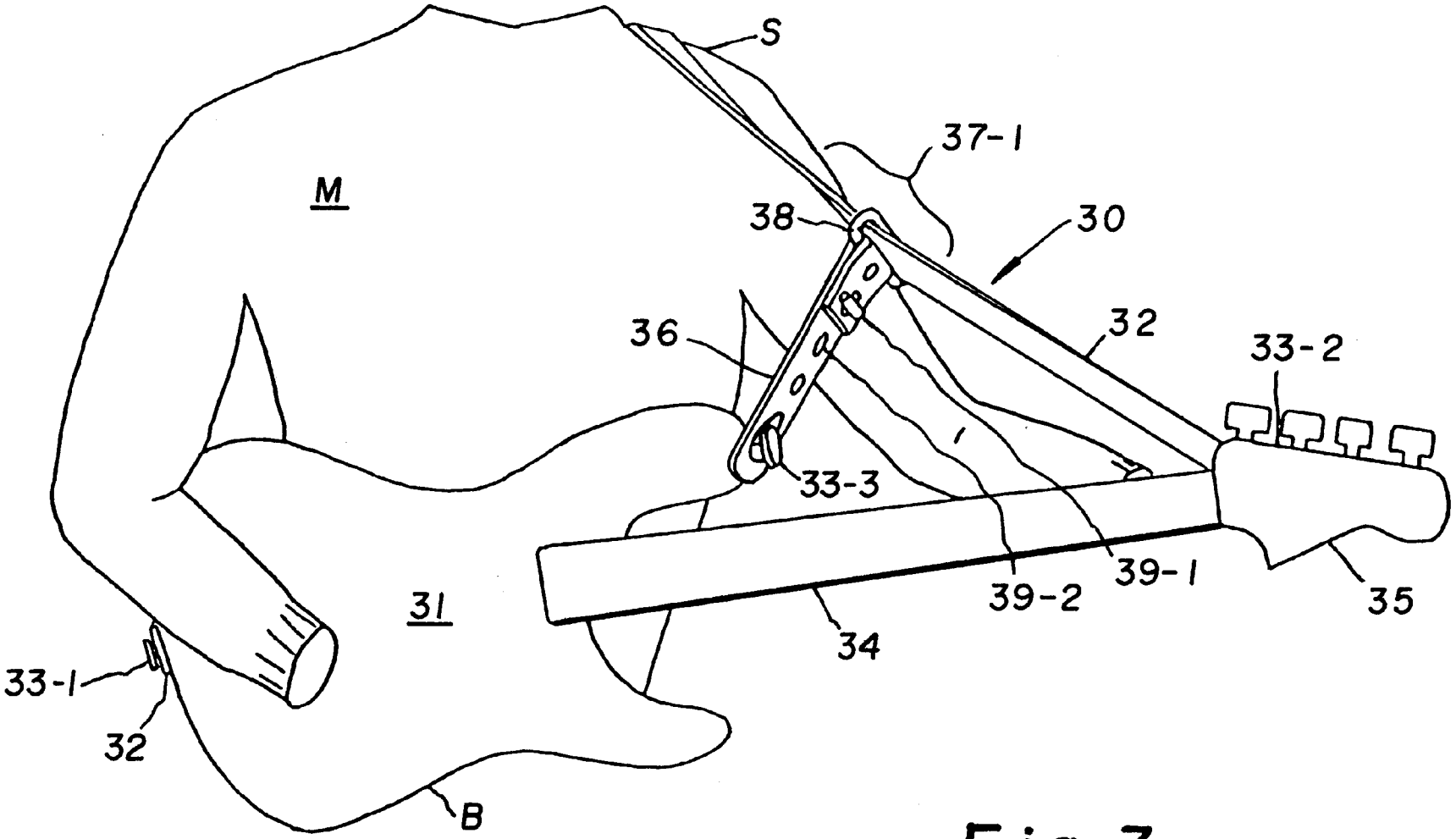
FIG. 3 is a partial frontal view showing the musician of FIGS. 1 and 2 with a guitar suspended from the shoulder using a suspension harness in accordance with the invention.

In order to increase the facility with which a suspended musical instrument can be manipulated, the invention provides a three point harness 30 as shown in FIG. 3. The harness 30 is attached to guitar 31 suspended from shoulder S of musician M. The three point harness 30 is attached to guitar 31 at three hook positions 33-1, 33-2 and 33-3. The harness contains a strap 32, which has one of its ends attached to the hook position 33-1 at the usual position of attachment on the main body B of instrument 31. The opposite end of the strap 32 is attached at the usual position of attachment 33-2 behind the enlarged head or pad 35 and near the terminus of the elongated neck 34. To complete the connection of strap 32 to instrument 31, an intermediate attachment 36 extends from an intermediate position 37-1 on strap 32 to attachment joint 33-3, near the junction of body B and elongated neck 34. Intermediate attachment 36 contacts strap 32 by means of a ring 38, which loops about strap 32. Both the length of the intermediate attachment 36 and the location 37-1 where the ring 38 contacts the strap 32 can be made adjustable in accordance with the amount of counterbalance and security that is needed for the harness to provide a suitable suspension. The length of intermediate attachment 36 is adjustable by means of button 39-1 and button holes 39-2. In FIG. 3, bracket 37-1 indicates that ring 38 is moveable along strap 32, showing a typical range of movement as the musician manipulates the instrument. The harness depicted in FIG. 3 has an added advantage in that the musician could use the harness while seated, and at the same time play the instrument in a secure fashion. A still additional advantage of this harness is that the combination of it and the instrument can be mounted on and off the musician without removing any attachments to the instrument. As shown in FIG. 3, harness 30 is extended about the neck of musician M between connection points 33-1 and 33-3 on the instrument.

Figure 4:
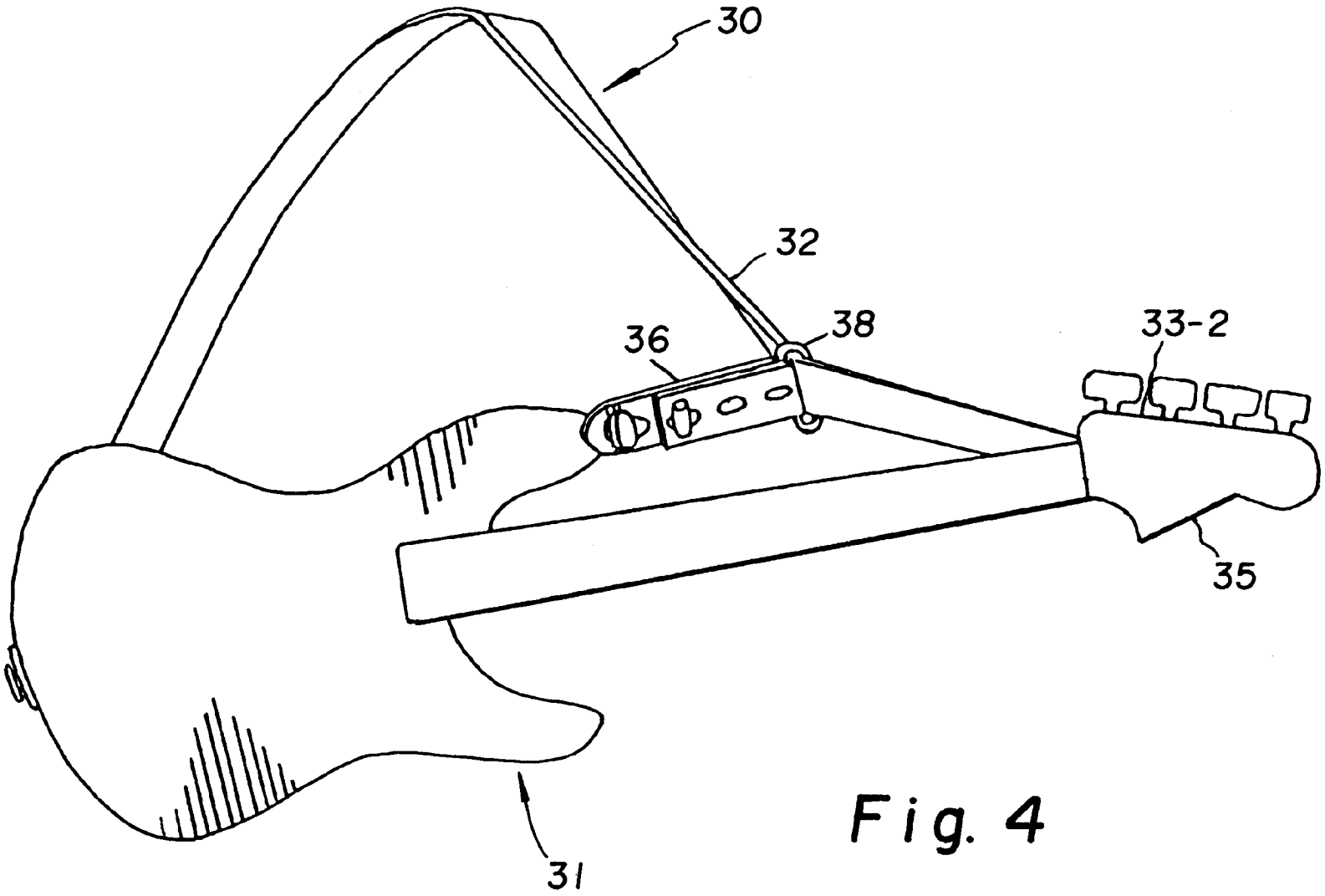
FIG. 4 is a view illustrating the adjustment of the suspension harness of FIG. 3 using a loop intermediate connection.

FIG. 4 shows details of the suspension harness 30 of FIG. 3. For clarity, the musician is not shown in FIG. 4. FIG. 4 illustrates adjustment of harness 30 such that intermediate attachment 36 has shorter length than that illustrated in FIG. 3.

Figure 5:
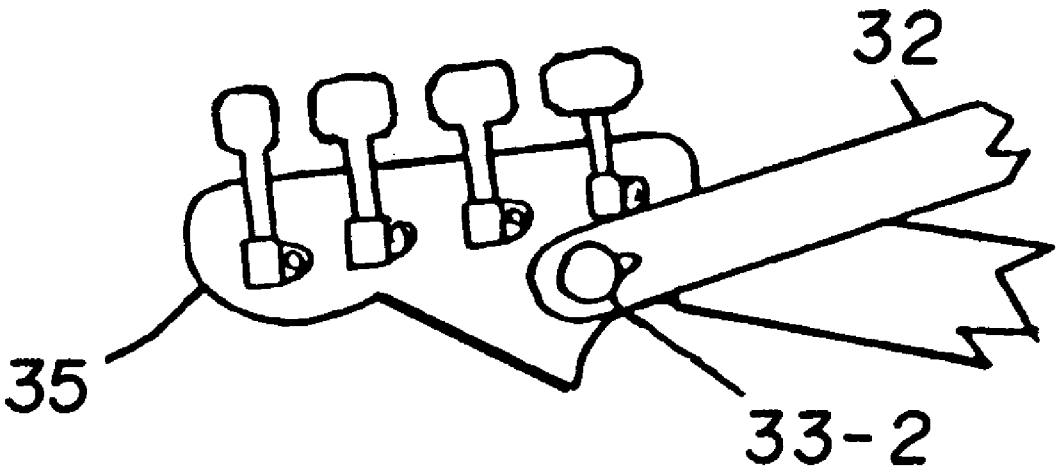
FIG. 5 is a back-side detail view of the head pad 35 of FIG. 4.

FIG. 5 is a back-side detail view of the head pad 35 of FIG. 4, showing the conventional attachment 33-2 to the instrument.

Figure 6:
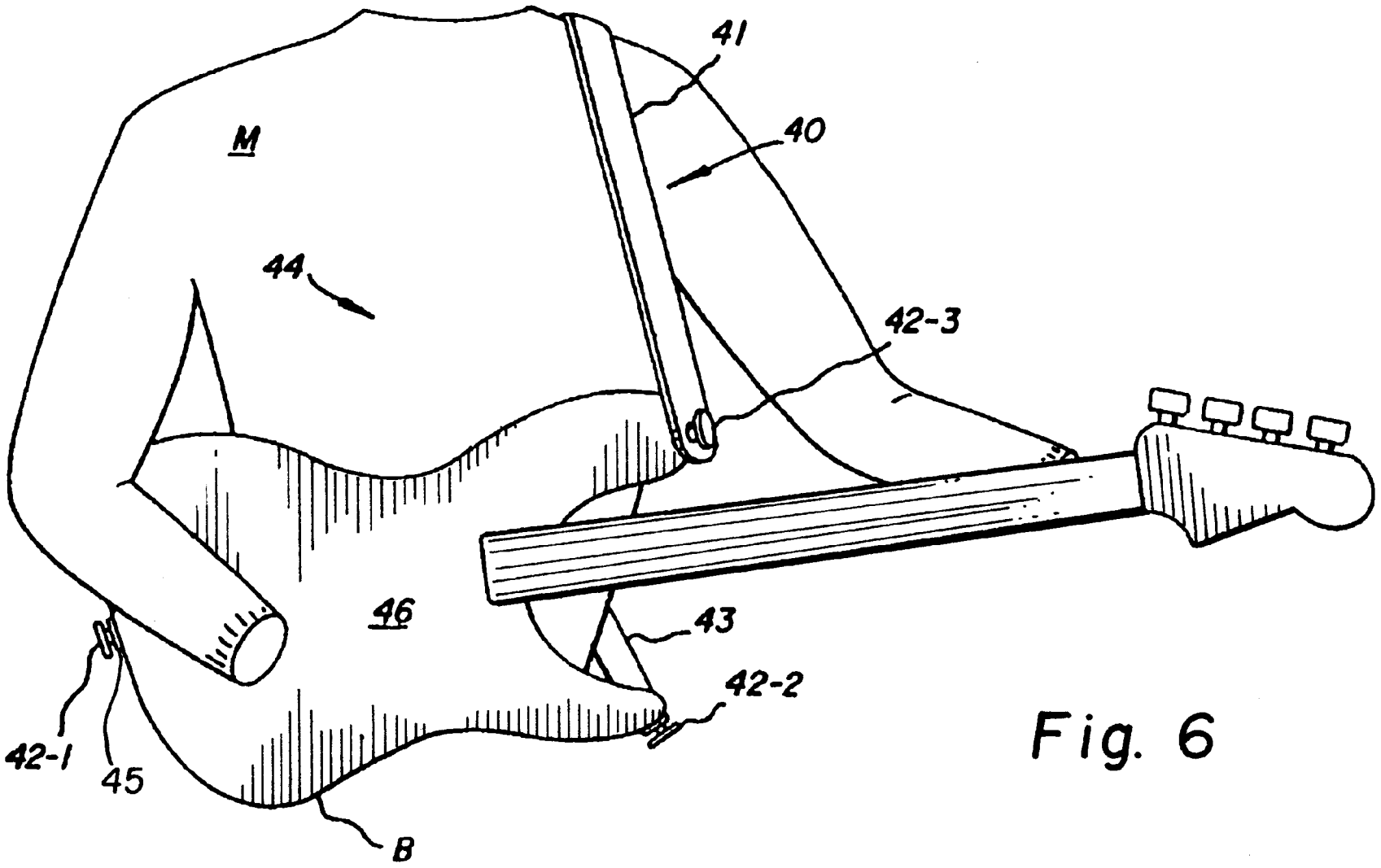
FIG. 6 is a partial frontal view showing a musician with a guitar suspended from the shoulder using a suspension harness in another adaptation of the invention.

FIG. 6 is a partial frontal view of a musician M using a harness 40 in another adaptation of the invention. Guitar 46 is suspended about musician M by means of the three separate and distinct attachment points 42-1, 42-2, and 42-3 on body B of guitar 46. Strap 41 is attached to the instrument at attachment point 42-1, strap 43 is attached to the instrument at attachment point 42-2, and strap 45 is attached to the instrument at attachment point 42-3. In the adaptation of FIG. 6, a main strap of harness 40 comprises strap 41 and strap 45, which are attached at attachment position 44 behind musician M. Any of the straps 41, 43 and 45 can be made length adjustable. For instance, buttons and button holes can be utilized in the manner depicted by intermediate attachment 36 of FIG. 3.

Figure 7:
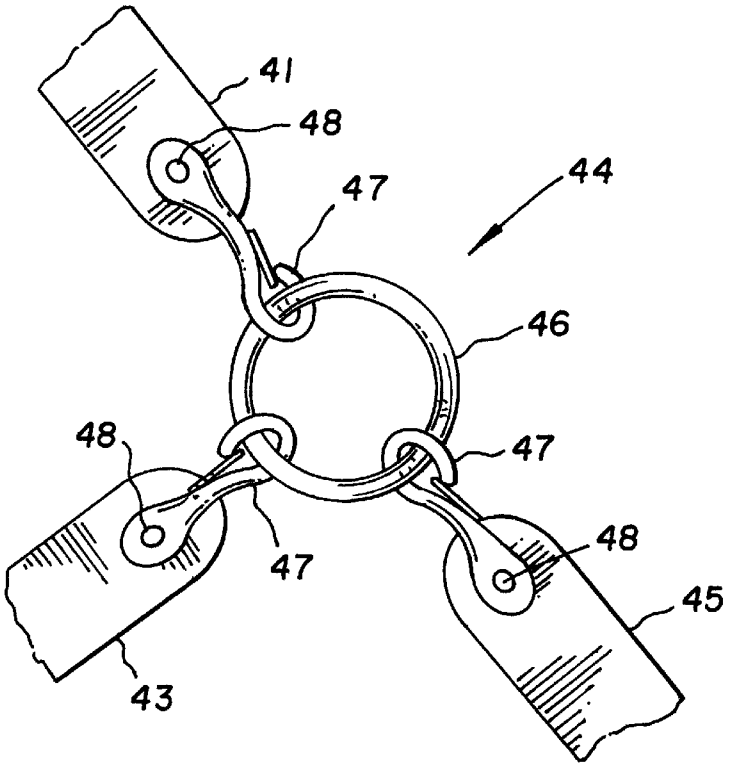
FIG. 7 is a detail of the intermediate connection to the strap of FIG. 6 viewed from behind the musician.

FIG. 7 is a back-side view detail of the attachment position 44 behind the musician M of FIG. 6. In FIG. 7, hooks 47 are attached to strap 41, strap 43 and strap 45 by means of rivets 48, which allow rotation of hooks 47 about the three strap ends. Hooks 47 are also looped about the circumference of ring 46, attaching and securing strap 41, strap 43 and strap 45 to a common element, while at the same time allowing free angular movement of the three straps about ring 46. In this adaptation of the invention, the main strap of harness 40 consists of strap 41, strap 45 and the common element, ring 46, while the intermediate connection comprises strap 43.

Figure 8:
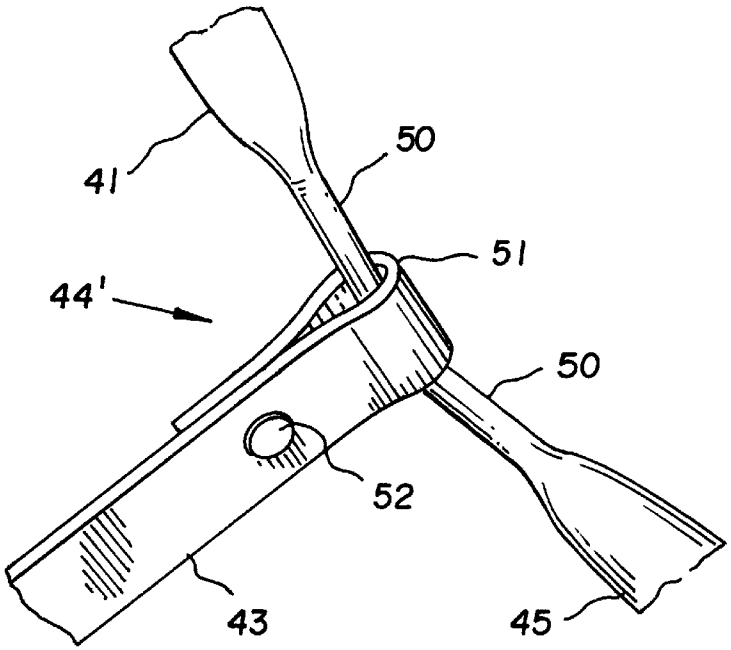
FIG. 8 is a detail of an alternate adaptation of the intermediate connection to the strap of FIG. 6 viewed from behind the musician.

FIG. 8 is a back-side view detail of the attachment position 44 behind the musician M of FIG. 6, using an alternative means for attachment of the intermediate connection. In FIG. 8, strap 41 and strap 45, which are flat members for much of their length, are joined together by an intervening component 50 that is not flat in cross section, but that has circular cross section, and to which strap 41 and strap 45 are attached. In this adaptation of the invention, the main strap of harness 40 consists of strap 41, strap 45 and their intervening component 50. The intermediate connection comprises strap 43, of which one end contains a loop 51, maintained by means of rivet 52. Loop 51 secures strap 43 to the intervening component 50 in a way that allows free linear movement of strap 43 along the main strap.

It will be understood that the foregoing embodiments are for illustration only and that other adaptations and aspects of the invention will be readily apparent to those of ordinary skill in the art. It will be appreciated that the musical instrument can be a guitar with a resonant chamber joined to a head end by a stringed neck.

What is claimed:

1. A harness for the suspension of a musical instrument, which includes a plurality of attachment points, comprising suspension means;

means for attaching said suspension means to one of said attachment points of said instrument;

means for attaching said suspension means to another one of said attachment points of said instrument;

means for attaching said suspension means to still another one of said attachment points of said instrument;

the attachment of said suspension means to said instrument limiting the extent to which said suspension means can be displaced from said instrument.

2. A harness as defined in claim 1 wherein said instrument is a guitar having said plurality of attachment points, and said suspension means is attached to said guitar at three separated ones of said attachment points.

3. Apparatus as defined in claim 1 wherein said suspension means comprises a main strap with a first end including said means for attaching said suspension means to said one of said attachment points, and a second end including said means for attaching said suspension means to said another of said attachment points and a secondary strap with a first end including said means for attaching said suspension means to said still another of said attachment points, and a second end including means for attachment to said main strap at a position intermediate said first and said second ends of said main strap.

4. A harness as defined in claim 1 wherein said suspension means comprises first, second and third straps, each having first and second ends, with the first ends conjoined and the second ends connected separately to said attachment points on said instrument.

5. Apparatus as defined in claim 1 further including a ring having a circumference and said suspension means comprises first, second and third straps, each having first and second ends;

said first ends containing means for looping about and securing to said circumference of said ring; and said second ends being connected to attachment points on said instrument.

6. A harness as defined in claim 1 wherein at least one of said means for attaching said suspension means to said one of said attachment points, said means for attaching said suspension means to said another of said attachment points or said means for attaching said suspension means to said still another of said attachment points is connected removably to said instrument.

7. Apparatus as defined in clam 4 wherein said second end of said secondary strap loops about said main strap, allowing said secondary strap to slide along the length of said main strap while remaining secured to said main strap.

8. Apparatus as defined in claim 7 wherein the length of said secondary strap is adjustable.

9. Apparatus as defined in claim 3 wherein said main strap has a width, and a thickness less than said width, and said means for attachment of said second end of said secondary strap to said main strap is removable.

10. A method of balancing an instrument on the body of a player, comprising the steps of:

(a) attaching a harness to three distinctive positions on said instrument; and (b) positioning said harness on said body of said player.

11. The method as defined in claim 10 further including the step of positioning said harness on said body of said player between two of said positions.

12. The method of claim 11 wherein said instrument is a guitar and said player has a neck extending from said body, further including the steps of (a) extending said harness about said neck between two separated positions of said instrument and (b) moving said harness to achieve a balanced orientation of said instrument without applying a countervailing torque to said instrument.

13. The method of claim 12 wherein said harness includes a strap of adjustable length, further including the step of adjusting said length to alter the position of said guitar in relation to said body of said player.

14. A harness as defined in claim 1 for positioning and stabilizing a musical stringed instrument, wherein:

(a) said suspension means comprises a backpiece;

(b) said means for attaching said suspension means to said one of said attachment points comprises a first segment having a first and second end; a first attachment means for attaching said first end of said first segment to said backpiece; a first anchoring means for anchoring said second end of said first segment to said instrument;

(c) said means for attaching said suspension means to said another of said attachment points comprises a second segment having a first and second end; a first attachment means for attaching said first end of said second segment to said backpiece; a second anchoring means for anchoring said second end of said second segment to said instrument;

(d) said means for attaching said suspension means to said still another of said attachment points comprises a third segment having a first and second end; a third attachment means for attaching said first end of said third segment to said backpiece; a third anchoring means for anchoring said second end of said third segment to said instrument; wherein each of said first, second and third segments is independent from any other of said segments.

15. A harness for positioning and stabilizing a musical stringed instrument as recited in claim 14, including means for adjusting the length of said first, second and third segments.

16. A harness for positioning and stabilizing a musical stringed instrument as defined in claim 14 wherein:

(a) said first segment has said second end anchored to a first instrument anchoring means of said instrument;

(b) said second segment has said second end anchored to a second instrument anchoring means of said instrument;

(c) said third segment has said second end anchored to a third instrument anchoring means of said instrument;

wherein each of said first, second and third segments is independent from any other of said segments.

17. A harness for positioning and stabilizing a musical stringed instrument, as recited in claim 16, including means for adjusting the lengths of said first, second and third segments.

18. Apparatus for the suspension of a musical instrument as defined in claim 1 wherein said suspension means comprises a main strap having first and second ends;

said means for attaching said suspension means to said one of said attachment points attaches said first end of said main strap to said instrument;

said means for attaching said suspension means to said another of said attachment points attaches said second end of said main strap to said instrument; and said means for attaching said suspension means to said still another of said attachment points attaches said main strap to said instrument at a position thereon displaced from said means for attaching said suspension means to said one of said attachment points and said means for attaching said suspension means to said another of said attachment points;

thereby to limit the extent to which said main strap can be displaced from said instrument.

19. Apparatus as defined in claim 18 wherein said means for attaching said suspension means to said still another of said attachment points has a length that is adjustable; comprised of a loop that enables said means for attaching said suspension means to said still another of said attachment points to be attached at any position along the length of said main strap between said first and second ends; said main strap being provided with more than one discrete location providing means for connection to said means for attaching said suspension means to said still another of said attachment points, which is comprised of a secondary strap having first and second ends, with said first end of said secondary strap attached to said main strap and said second end of said secondary strap attached to said instrument; and said main strap is comprised of a ring and two minor straps, each having a first end and a second end, with said first ends of said minor straps attached to said ring and said first end of said secondary strap attached to said ring.

20. A harness as defined in claim 1 wherein one of said means for attaching said suspension means to said one of said attachment means or said means for attaching said suspension means to said another of said attachment means has an intermediate position and said means for attaching said suspension means to said still another attachment point of said instrument extends from said intermediate position.

* * * * *